US005743632A

United States Patent [19]

Carl

[11] Patent Number: 5,743,632

[45] Date of Patent: Apr. 28, 1998

[54] THERMALLY CONTROLLED LIGHT FIXTURE

[75] Inventor: Michael J. Carl, New Braunfels, Tex.

[73] Assignee: The Genlyte Group Incorporated, Union, N.J.

[21] Appl. No.: 748,239

[22] Filed: Nov. 12, 1996

[51] Int. Cl.[6] ..... F21V 29/00

[52] U.S. Cl. ..... 362/294; 362/268; 362/373

[58] Field of Search ..... 362/96, 268, 267, 362/294, 345, 373, 153; 52/171.3

[56] References Cited

U.S. PATENT DOCUMENTS

| | | | |
|---|---|---|---|
| 2,080,120 | 5/1937 | Everett | 362/294 |
| 3,202,070 | 8/1965 | Pratt, Jr. et al. | 362/294 |
| 3,299,591 | 1/1967 | Woelk | 52/203 |
| 3,347,008 | 10/1967 | Strengholt | 52/398 |
| 3,711,702 | 1/1973 | Adra | 240/470 |
| 3,940,898 | 3/1976 | Kaufman | 52/400 |
| 3,990,201 | 11/1976 | Falbel | 52/171 |
| 4,015,394 | 4/1977 | Kessler | 52/616 |
| 4,069,630 | 1/1978 | Chess et al. | 52/171 |
| 4,450,660 | 5/1984 | Dean et al. | 52/202 |
| 4,459,789 | 7/1984 | Ford | 52/171.3 |
| 4,546,420 | 10/1985 | Wheeler et al. | 362/268 |
| 4,717,991 | 1/1988 | Murphree, Jr. | 362/294 |
| 4,766,709 | 8/1988 | Galbraith | 52/235 |
| 4,786,344 | 11/1988 | Beuther | 156/109 |
| 5,446,637 | 8/1995 | Cunningham et al. | 362/321 |

FOREIGN PATENT DOCUMENTS

| | | | |
|---|---|---|---|
| 1380020 | 1/1975 | United Kingdom | 362/373 |

*Primary Examiner*—Y My Quach

*Attorney, Agent, or Firm*—Vaden, Eickenroht & Thompson, L.L.P.

[57] ABSTRACT

An apparatus and method for thermally controlling a light fixture contemplate the use of a housing for holding a high-wattage, heat-producing lamp, with the housing having an opening through which light emanates from the lamp. Two lenses are provided, and mounting means support the lenses in spaced layered relation so as to form a thermal barrier that at least partially encloses the opening of the housing whereby the lens furthest from the heat-producing lamp is maintained cooler than the lens closest to the lamp.

3 Claims, 2 Drawing Sheets

THERMALLY CONTROLLED LIGHT FIXTURE

BACKGROUND OF THE INVENTION

1. Field of the Invention

The present invention relates to high wattage light sources, particularly light fixtures installed in public areas where it is desirable to keep the outer lens temperature controlled below a point that will cause discomfort if touched, and further to avoid transferring excessive heat to the environment surrounding the fixtures.

2. The Related Art

There are many situations in which it is beneficial, from a lighting standpoint, to utilize high wattage light sources, e.g., lamps. Such situations include tree lighting, facade lighting, and flagpole lighting, to name a few. Often, these light sources must be mounted at lower elevations, even on the ground, to achieve the desired lighting effect. The extreme heat produced by the high wattage light source presents a risk that members of the public touching the light source, or a part thereof such as the outer lens, will be exposed to high temperature surfaces.

One method of controlling the temperature of such light sources is to limit the wattage and type of lamp used in a light fixture, thereby ensuring that the external lens temperature is maintained within a comfortable range. However, this method is not practical for a large percentage of outdoor lighting applications because the surfaces to be lit are typically large and require long light throws.

U.S. Pat. No. 4,546,420 describes one solution to the high temperature problem in an elongated light fixture that utilizes a high-intensity, seal beam lamp. A filter pack and fan assembly are employed to maintain the desired operating temperature of the lamp within the fixture so as to maximize the efficiency of the lamp. No suggestion is made of controlling the external temperature of the fixture below a desirable point. The fan draws ambient air through the filter pack, which contains a plurality of filters each having portions cut away and arranged so as to create a tortuous air path directing the air flow between and around the filters to carry excessive heat away from the lamp. Thus, forced convection is the primary means of transferring heat away from the high-intensity lamp.

U.S. Pat. No. 5,446,637 addresses the problem of high-intensity light fixtures projecting an undesired amount of infrared light along with the visible light, which, e.g., causes discomfort to a person positioned at the site of an imaged spotlight beam. The patent describes a high-intensity light fixture having a parabolic reflector constructed of borosilicate glass coated with multiple thin-film layers of a dielectric coating. Thus, the reflector exhibits a dichroic characteristic, reflecting a high proportion of visible light while transmitting a high proportion, i.e., reflecting a low proportion, of infrared light. However, such reflectors do not address the problem of infrared light being transmitted directly from a high-intensity lamp to the fixture lens and thereby generating enough heat at the lens to burn someone touching the fixture.

In response to the shortcomings of the prior art, it is an object of the present invention to provide a thermally controlled light fixture that requires no moving parts for inducing convection cooling.

It is a further object to provide a multiple lens configuration that creates at least one thermal barrier to limit the transfer of heat to the outer-most lens of a light fixture.

It is a further object to provide valve means for evacuating the air or replacing it with an inert gas between the lenses of the multiple lens configuration to further inhibit the transfer of heat to the outer-most lens.

It is a further object to provide a lens having a dichroic coating to restrict the passage of infrared energy in a simple, economic fashion.

SUMMARY

The objects described above, as well as other objects and advantages are achieved by an apparatus and method that contemplate the use of a thermally controlled light fixture that includes a housing for holding a high-wattage, heat-producing lamp. The housing has an opening through which light emanates from the lamp. Two lenses are provided, and mounting means support the lenses in spaced layered relation so as to form a thermal barrier that at least partially encloses the opening of the housing whereby the lens furthest from the heat-producing lamp is maintained cooler than the lens closest to the lamp.

In a preferred embodiment, the supporting means includes a resilient seal assembly for sealing the thermal barrier formed by the lenses, and a valve for evacuating air within the sealed thermal barrier. The valve is also operable for replacing the air in the sealed thermal barrier with an inert gas.

In a further embodiment, the lens closest to the lamp is coated with a dichroic substance to reflect infrared radiation away from the lens furthest from the lamp.

BRIEF DESCRIPTION OF THE DRAWINGS

In the drawings, wherein like reference characters are used throughout to describe like parts.

DETAILED DESCRIPTION OF THE PREFERRED EMBODIMENT

Figure 1:
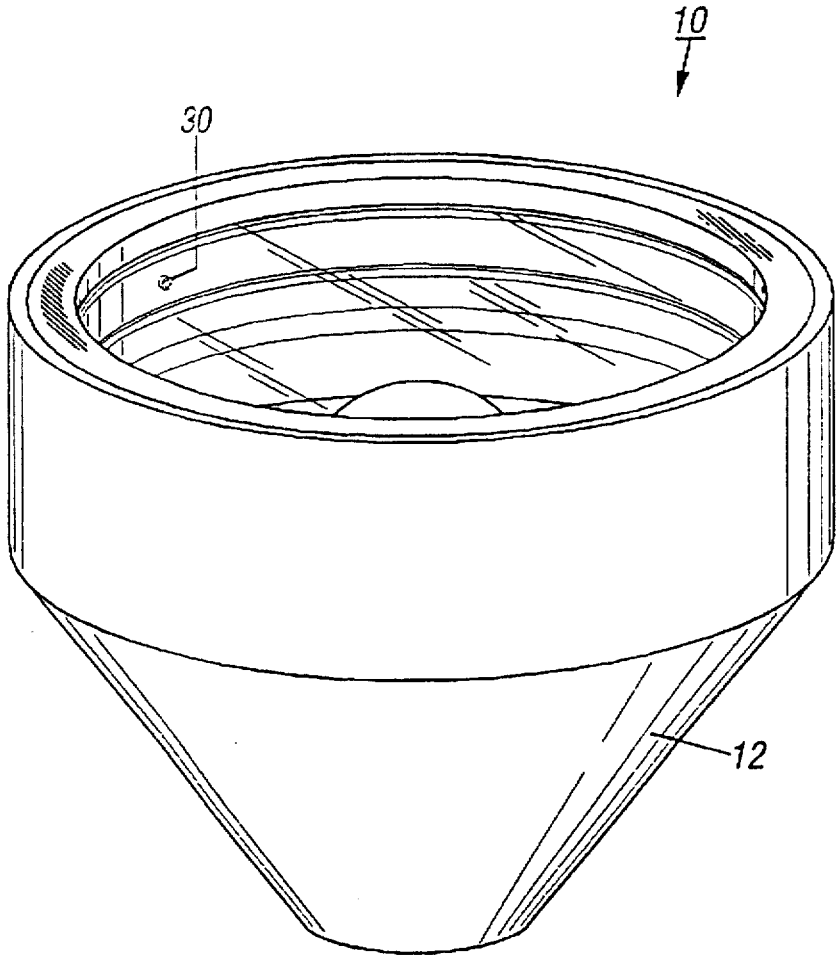
FIG. 1 is a perspective view of a light fixture in accordance with the present invention.
Figure 2:
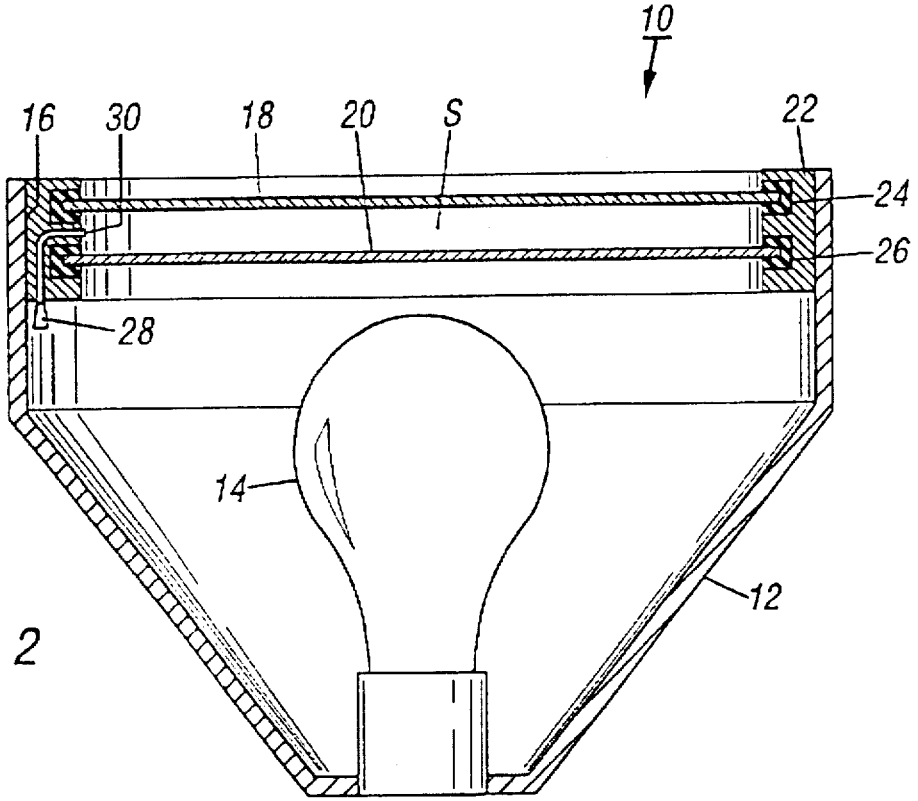
FIG. 2 is a sectional view, in elevation, of the light fixture of FIG. 1.

FIGS. 1 and 2 illustrate a thermally controlled light fixture 10 that embodies the thermal barrier approach of the present invention. Light fixture 10 includes a housing 12 for holding high-wattage, heat-producing lamp 14 and having opening 16 through which light emanates from the lamp. Two heat-treated or tempered glass lenses 18, 20 are provided for covering the opening of housing 12.

Supporting means in the form of mounting ring 22 containing resilient seals 24, 26 support lenses 18, 20 in spaced layered relation so as to form a thermal barrier at the lenses that encloses opening 16 and inhibits the transfer of heat across space S between the lenses. The resilient seals may be of a conventional gasket material, or other suitable sealing materials commonly used in the art. As a result of this configuration, the lens furthest from the heat-producing lamp, lens 18, is maintained cooler than the lens closest to the lamp, lens 20.

Mounting ring 22 includes valve 28 positioned therein for evacuating the air within the thermal barrier formed by the lenses. The valve is further operable for replacing the air between the lenses with a clear, inert gas, such as nitrogen. Thus, once the lenses have been assembled and sealed in the supporting means, a vacuum source is connected to valve 28 for removing the air between lenses 18 and 20 via gas conduit 30, thereby creating a more efficient thermal barrier and significantly reducing the heat transferred to outer lens 18 from lamp 14. Once the air has been evacuated from space S, the space can be charged with the inert gas through valve 28 if so desired.

Figure 3:
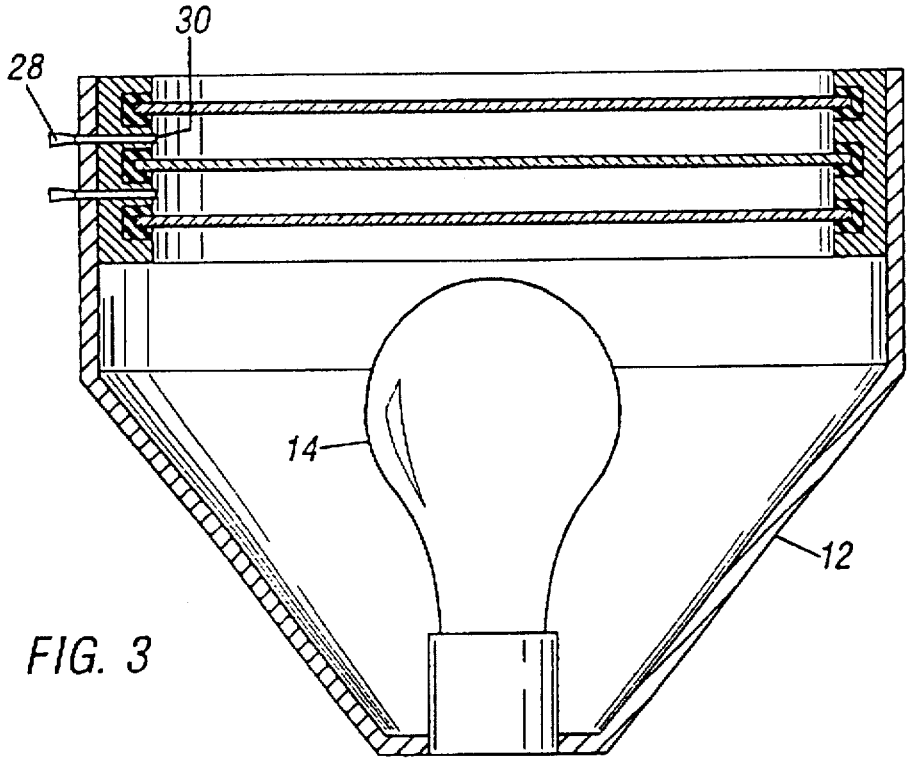
FIG. 3 is a sectional view, in elevation, of an alternative embodiment of the light fixture having three parallel lenses.

The positioning of valve 28 on the inner side of ring 22 necessitates removal or replacement of the air between the lenses prior to mounting the supporting means in opening 16. Alternatively, valve 28 could extend through the wall of housing 12 for communicating with space S through conduit 30 at any time, as shown in the embodiment of FIG. 3 which is described further below.

The effectiveness of the thermal barrier may be further enhanced by coating inner lens 20 with a dichroic substance to reflect infrared radiation away from outer lens 18, and thereby further reduce the temperature of lens 18. The reflected radiation may then be dissipated elsewhere in the fixture, such as through the means for mounting housing 12 to the ground or other lighting mount.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense. For example, the light fixture may be equipped with three lenses mounted in spaced, layered relation to create a double thermal barrier that further reduces the amount of heat transferred to the outermost lens from lamp 14, as illustrated in FIG. 3.

Also, mounting ring 22 need not be mounted to housing 12, but may be mounted to other means (not shown) that supports the spaced, layered lens assembly in a position to only partially cover opening 16 of housing 12, thereby permitting hot air to escape from inside the fixture by natural convection.

What is claimed is:

1. A thermally controlled light fixture, comprising:

a housing for holding a high intensity, heat-producing lamp and having an opening through which light emanates from the lamp, said housing being adapted for mounting adjacent the ground in a publically accessible area so as to illuminate one of an object and a surface substantially above the ground;

at least two lenses;

mounting means for supporting said lenses in spaced layered relation, said mounting means including a resilient seal assembly forming a sealed thermal barrier between the lenses that at least partially encloses the opening of said housing such that one of said lenses is an outer lens positioned furthest from the heat-producing lamp and another of said lenses is an inner lens, whereby a temperature of the outer lens is maintained below a temperature that would cause discomfort if touched; and a valve positioned within said mounting means for evacuating air within the sealed thermal barrier.

2. The light fixture of claim 1 wherein said valve is further operable for replacing the air in the sealed thermal barrier with an inert gas.

3. The light fixture of claim 1 wherein the inner lens closest to the lamp is coated with a dichroic substance to reflect infrared radiation away from the outer lens furthest from the lamp.

* * * * *